United States Patent [19]

Stienen

[11] Patent Number: 4,624,090

[45] Date of Patent: Nov. 25, 1986

[54] NODE ELEMENT AND FRAMEWORK BAR FOR TRIDIMENSIONAL FRAMEWORKS

[75] Inventor: Karl H. Stienen, Boll, Switzerland

[73] Assignee: Paul Trohler, Bolligan, Switzerland; a part interest

[21] Appl. No.: 694,446

[22] PCT Filed: Mar. 23, 1984

[86] PCT No.: PCT/CH84/00051

§ 371 Date: Dec. 18, 1984

§ 102(e) Date: Dec. 18, 1984

[87] PCT Pub. No.: WO84/04123

PCT Pub. Date: Oct. 25, 1984

[30] Foreign Application Priority Data

Apr. 19, 1983 [CH] Switzerland ..... 2089/83

[51] Int. Cl.[4] ..... E04H 12/18

[52] U.S. Cl. ..... 52/648; 403/172

[58] Field of Search ..... 403/172, 176; 52/81, 52/DIG. 10, 648, 646

[56] References Cited

U.S. PATENT DOCUMENTS

| | | | |
|---|---|---|---|
| 3,333,375 | 8/1967 | Johnston | 52/81 |
| 4,355,918 | 10/1982 | Van Vliet | 52/81 |

FOREIGN PATENT DOCUMENTS

| | | | |
|---|---|---|---|
| 405398 | 7/1909 | France | 52/81 |
| 2136936 | 12/1972 | France . | |
| 2250395 | 5/1975 | France . | |
| 2310488 | 5/1976 | France . | |

*Primary Examiner*—James L. Ridgill, Jr.

*Attorney, Agent, or Firm*—Brady, O'Boyle & Gates

[57] ABSTRACT

A spherical node element body is composed of several parts (31, 32, 33) held together by a screw (3), these parts contacting each other in pairs along boundary surfaces (35, 36) lying in a plane containing the geometrical nodal point (6) and along boundary surfaces (37, 38) inclined with respect to this plane and oriented toward the nodal point (6). By indentations at these boundary surface pairs (35/36 and 37/38), open cavities (20, 21) oriented toward the geometrical nodal point (6) are formed on the outside of the body, these cavities receiving in a force-derived and/or shape-mating connection respectively one extension (23) of a framework bar end (24) adapted to such cavity (20, 21).

7 Claims, 7 Drawing Figures

NODE ELEMENT AND FRAMEWORK BAR FOR TRIDIMENSIONAL FRAMEWORKS

The invention relates to a node element and a framework bar for tridimensional frameworks.

A node element having a pair of parallel, plate-like parts for each framework bar to be connected thereto, and a framework bar designed at its ends to be flat, fitting between one of the pairs of plate-like parts, are conventional. For assembly, the flat bar ends are introduced respectively between one of the pairs of plate-like parts and clamped in place between these parts by means of a screw or rivet (DOS No. 1,609,538). The manufacture of this node element, as well as the assembly of tridimensional frameworks with such node elements and framework bars is expensive. Besides, this node element falls short from satisfying the esthetic wishes of architects.

The invention, as characterized in the claims, solves the problem of providing a simple to manufacture node element and a framework bar adapted thereto, the assembly of which requires less time and the arrangement of which can very extensively meet any esthetic desires.

The invention will be described in greater detail below with reference to the drawing which shows only two embodiments. In the drawing.

Figure 2:
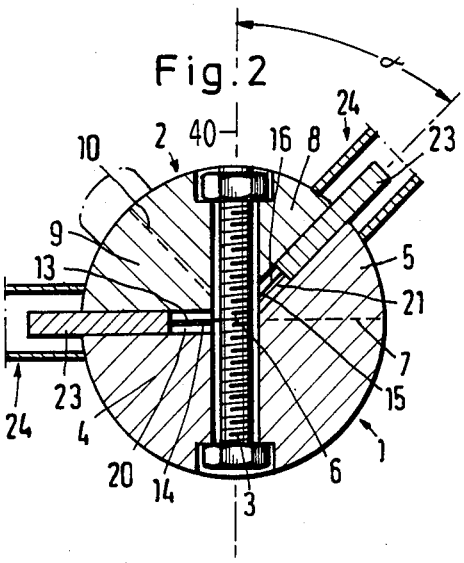
FIG. 2 shows a section along line II—II in FIG. 1.
Figure 4:
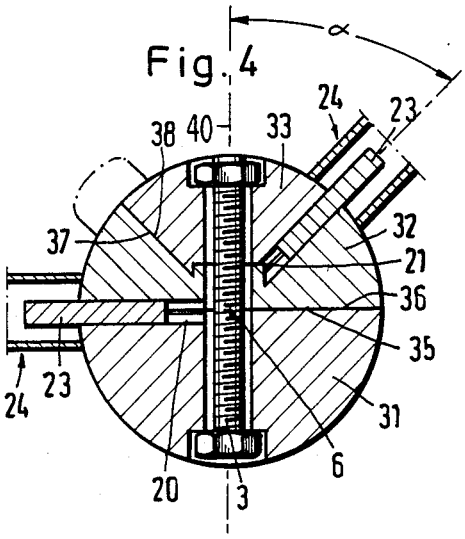
FIG. 4 shows a section along line IV—IV in FIG. 3.
Figure 5:
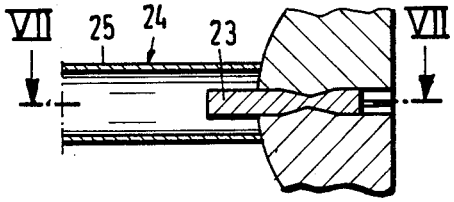
Figure 6:
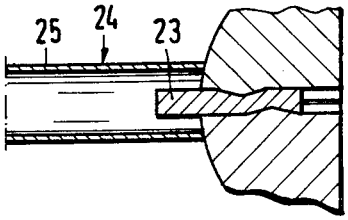

FIGS. 5 and 6 each shows a modification of FIGS. 2 and 4, and

Figure 7:
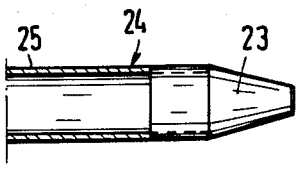

FIG. 7 shows a section along line VII—VII in FIG. 5 through the framework bar end.

Figure 1:
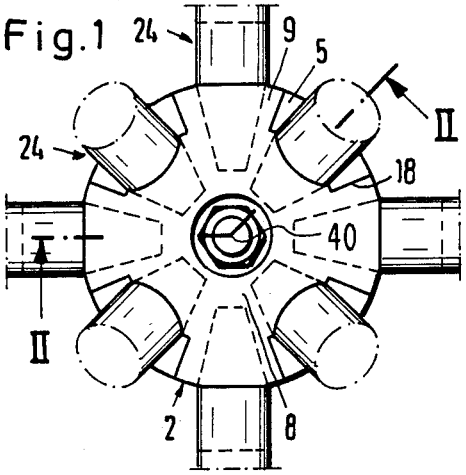
FIG. 1 is a top view of a framework node.

According to FIGS. 1 and 2, a spherical node element body is composed of two parts 1 and 2 held together on a common axis 40 by a screw 3. Part 1 has the shape of a hemisphere 4 with extensions 5 formed thereat with mutual spacings; these extensions are parts of spherical wegdes cut off at an angle $\alpha$ of 45° with respect to the axis 40 of the sphere. In FIG. 2, the demarcation between the hemispherical shape and one of the extensions 5 is illustrated by a dotted line 7. The other part 2 has the form of a section of a sphere (spherical segment) 8 with integrally formed extensions 9 extending in between the extensions 5 and likewise constituting portions of spherical wedges. In FIG. 2, the demarcation between the spherical segment form and one of the extensions 9 is indicated by a dotted line 10.

The end face 13 of each extension 9, at the bottom in FIG. 2, and one of the surface 14 extending at the hemispherical base 7 between two extensions 5 form a pair of mutually adjoining and/or proximate (see below) boundary surfaces of parts 1 and 2. The end face 15 of each extension 5, at the top in FIG. 2, and one of the surfaces 16 extending at the shell 10 of the spherical section form 8 between two extensions 9 form additional pairs of mutually adjoining and/or proximate (see below) boundary surfaces. Furthermore, the wedge surfaces (lateral surfaces) 18 of proximate extensions 5 and 9 are in contact with each other. A cavity 20 and 21, respectively, oriented toward the center 6 of the sphere and open at the spherical surface, is formed at each of these two boundary surface pairs 13, 14 and 15, 16, alternating with each other in the peripheral direction (based on the axial line 40 of the screw 3); in this cavity, an extension 23 of a framework bar 24 is accommodated and held therein by a force-derived connection or, according to FIGS. 5 or 6, in a shape-mating and, respectively, a force-derived and shape-mating connection. In order to form these cavities 20 and 21, respectively one, or both, of the boundary surfaces can be provided with an indentation. The cavities can extend, in the peripheral direction (based on the axial line 40 of the screw 3) up to the wedge surfaces 18, so that the surfaces 13, 14 and 15, 16, respectively, of the boundary surface pairs are not in contact with each other, or are in contact only between the inner end of the cavity 20 or 21 and the bore provided for the screw 3 and are otherwise proximate to each other. In the illustrated embodiment, the extension 23 of the framework bars 24 is a plate seated partially in the tubular bar member 25 (FIGS. 5–7) and being tapered trapezoidally at the end projecting out of this tubular bar member; this plate is welded into slots of the tubular bar member 25 and, if the inner diameter of the tube is adequate, can also be welded to the tube on the inside. The extension 23 can also be formed on a peg inserted in the tube, this peg suitably having one or several holes making it possible to protect the extension-equipped framework bar from rusting even on the inside by hot-dip galvanizing. The extensions 23 can be provided, for shape-mating engagement, also with projections, for example bulges, instead of indentations (FIGS. 5 and 6); in this arrangement, the cross section of the extensions is not reduced and the indentations corresponding to the projections and to be provided at the suitably cast spherical components are more advantageous from the viewpoint of casting technique than protuberant zones corresponding to indentations in the extensions. Also, shape-mating engagement can be achieved by lateral projections, i.e. widened portions. The flank of projections facing the spherical surface can extend perpendicularly to the longitudinal direction of the bar so that the force occurring when tensile stress is exerted on the bar does not have a component which drives the spherical parts, between which the extension is held, apart.

Figure 3:
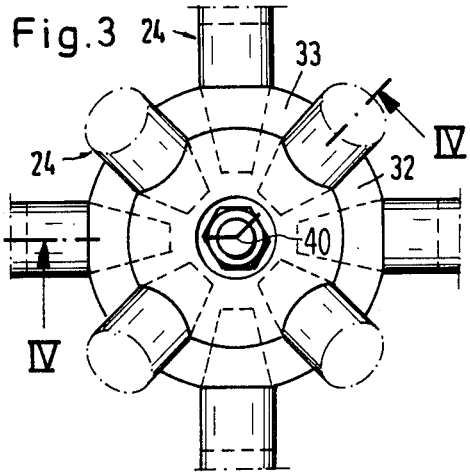
FIG. 3 shows a top view of another embodiment of a framework node.

According to FIGS. 3 and 4, a sperical node element body is composed of three parts 31, 32, and 33, held together on a common axis 40 by a screw 3. Part 31 has the shape of a hemisphere; part 32 is an annular component with a planar surface 36 in contact with or proximate to the planar surface 35 of the hemisphere 31. This part is delimited on the circumference by a spherical zone and on its side facing away from the hemisphere 31 by a conical surface 37 with the apex of the cone being located in the center 6 of the sphere. Part 33 is a spherical sector, the conical surface 38 of which adjoins the surface 37. The two planar surfaces 35 and 36 of parts 31 and 32 form a first pair of mutually contacting boundary surfaces, and the two conical surfaces 37 and 38 of parts 32 and 33 form a second pair of mutually contacting boundary surfaces. Several cavities for accommodating the extensions 23 of the framework bars 24, corresponding respectively to the cavities 20 and 21, are formed at each of these boundary surface pairs; the remarks set forth in connection with FIGS. 1 and 2 apply analogously to the present arrangement. The embodiment of FIGS. 3 and 4, due to its tripartite nature, provides improved force-derived connection and, respectively, requires less precision to obtain this objective than the embodiment described in conjunction with FIGS. 1 and 2. In both embodiments, the conical surfaces 15 and 16, or 37 and 38, can be replaced by the generated surfaces of a pyramid. This makes it possible to form the cavities 21 for framework bar ends 23 of rectangular cross section by an indentation on respectively only one of the surfaces of these boundary surface pairs 15, 16 and 37, 38. In case of the pairs with planar boundary surfaces 13, 14 and 35, 36, respectively, this is readily possible.

Although the spherical configuration is technologically suitable and esthetic, it is not required for functionality. The half which is at the top in FIGS. 2 and 4 can also have polyhedral boundaries, for example, while the lower half can be shaped extensively arbitrarily.

The node elements illustrated in FIGS. 1–4 are designed, as can be seen therefrom, for four chord bars lying in one plane and for four diagonal bars on one and the same side of the chord plane. The embodiment of FIGS. 3 and 4 can readily be designed for another four diagonal bars on the other side of the chord plane, by replacing part 31 by a part matching part 32 and a part matching part 33, which are to be arranged in mirror-image symmetry to parts 32 and 33.

I claim:

1. A framework bar and a node element for joining bars at the nodes of a tridimensional framework, wherein said a framework bar (24) has at each of its ends a plate-shaped extension (23) projecting in the longitudinal direction from the bar, each plate-shaped extension (23) having opposite side edges tapered towards its free end; said node element having a body including plural parts (1, 2; 31, 32, 33) which are stacked one on the other on a common axis (40), said plural parts each having a surface which faces the opposite surface of another (13/14, 15/16; 35/36, 37/38), the surface of each part which faces that of another including shallow indentations in registration with the shallow indentations in the opposite surface which between the opposite node element part surfaces define shallow cavities (20, 21) which are oriented towards a common point (6) in the center of said node element body on said common axis (40), said shallow cavities having side walls tapered towards the common point (6) and adapted to receive respectively one of said plate-shaped framework bar extensions (23), and means (3) for clamping said node element plural parts in the direction of said common axis (40) and thereby clamping said plate-shaped framework bar extensions (23) between said opposite node element part surfaces in said indentations forming said cavities (20, 21); said plate-shaped framework bar extensions (23) and said shallow indentations forming said cavities (20, 21) having configurations for shape-mating mounting said framework bar extensions (23) in said cavities (20, 21).

2. A framework bar and a node element as set forth in claim 1, in which said framework bar (24) comprises a tubular bar member (25) and including at each end thereof a plate-shaped extension (23) with a first portion fixedly seated in the end of the tubular bar member (25) and a second portion which projects out of said tubular member (25), and said second portion being trapezoidally tapered towards its (23) outer end.

3. A framework bar and node element as set forth in claim 1, in which said plural parts of said node element body comprise a first and a second part (1, 2), said first part (1) having extension portions (5) with end faces (15) angularly inclined ($\alpha$) to said common axis (40) and oriented toward said common point (6), said extension portions (5) projecting from a surface (14) of said first part (1) that is perpendicular to said common axis (4), said extension portions (5) being arranged at mutual spacings from each other around said common axis (40), said second part (2) having other extension portions (9) with end faces (13) perpendicular to said common axis (40), said other extension portions (9) projecting from a substantially conical surface (16) coaxial with said common axis (40) and oriented towards said common point (6); said extension portions (5) of said first part (1) extending in between said other extension portions (9) of said second part (2) with each of said end faces (15 and 13) of said extension portions (5 and 9) of one of said plural parts (1 and 2) facing, parallel thereto said surface (16 and 14) of the other part (2 and 1) of said plural parts from which the extension parts (9 and 5) respectively project; and said shallow cavities (20, 21) are formed respectively said parallel facing faces and surfaces (15/16 and 13/14).

4. A framework bar node element as set forth in claim 3, in which said node element body has a spherical shape, said first part (1) having the form of a hemisphere (4) with said extension portions (5) thereof projecting from its base (7) and constituting parts of spherical wedges, and said second part (2) has the from of a spherical segment (8) with said other extension portions (9) thereof likewise constituting parts of spherical wedges, extending in between the said extension portions (5) of said first part (1).

5. A framework bar and node element as set forth in claim 1, in which said plural parts of said node element body comprise a first (31), a second (32) and a third part (33), said first (31) and second (32) parts having surfaces (35, 36) facing each other which are planar and perpendicular to said common axis (40), and said second and third parts (32 and 33) having surfaces (37, 38) facing each other which are substantially conical and coaxial to said common axis (40), and with the apex of the substantially conical surfaces at said common point (6), and the shallow cavities (20, 21) being formed between said opposite planar surfaces (35/36) and between said opposite substantially conical surfaces (37/38).

6. A framework bar and node element as set forth in claim 5, in which said node element body (31, 32, 33) is spherical; said first part (31) having the form of a hemisphere with the base (35) thereof being one of said planar surfaces; said second part (32) being annular and having the other (36) of said planar surfaces on one side thereof, a spherical-zone outer surface and, one (37) of said substantially conical surfaces on the side opposite the other of said planar surfaces (36); and said third part (33) having the form of a spherical segment with the other (38) of said substantially conical surfaces as well as with an outer surface having the shape of a spherical cap.

7. A node element for joining framework bars at the nodes of a tridimensional famework, comprising a node element body having a first and a second part (1 and 2) which are stacked one (2) on the other (1) on a common axis (40); clamping means (3) for clamping said first and second parts (1, 2) in the direction of said common axis (40); said first part (1) having extensions (5) with end faces (15) inclined ($\alpha$) to said common axis (40), said extensions (5) of said first part (1) projecting from a surface (14) thereof perpendicular to said common axis (40) and being arranged at mutual spacings around said common axis (40); said second part (2) having other extensions (9) with end faces (13) perpendicular to said common axis (40), said other extensions (9) projecting from a substantially conical surface (16) coaxial with said common axis (40) and oriented towards said common point (6); said extensions (5) of said first part (1) extending in between said other extensions (9) of said second part (2) with said end faces (15 and 13) of said respective extensions (5 and 9) of one of said parts (1 and 2 respectively) facing, parallel thereto, said surface (16 and 14) of the other of said parts (2 and 1 respectively) from which the extensions (9 and 5) project; an framework bar (24) having opposite ends, and spaces (20, 21) provided between the opposite faces and surfaces (13/14 and 15/16) for fixedly receiving respectively one end of one of said framework bars (24).

* * * * *